US007474064B2

(12) United States Patent
Lai et al.

(10) Patent No.: US 7,474,064 B2
(45) Date of Patent: Jan. 6, 2009

(54) LAMP DRIVING CIRCUIT FOR A DISCHARGE LAMP AND A CONTROL METHOD THEREOF

(75) Inventors: Ting-Cheng Lai, Taichung (TW); Masakazu Ushijima, Tokyo (JP)

(73) Assignee: Greatchip Technology Co., Ltd., Taichung (TW)

( * ) Notice: Subject to any disclaimer, the term of this patent is extended or adjusted under 35 U.S.C. 154(b) by 0 days.

(21) Appl. No.: 11/832,644

(22) Filed: Aug. 1, 2007

(65) Prior Publication Data

US 2008/0030150 A1 Feb. 7, 2008

(30) Foreign Application Priority Data

Aug. 4, 2006 (TW) ..... 95128662 A

(51) Int. Cl.
*G05F 1/00* (2006.01)

(52) U.S. Cl. ..... 315/307; 315/291; 315/224; 315/209 R; 315/244; 315/DIG. 7

(58) Field of Classification Search ..... 315/209 R, 315/210, 211, 212, 219, 224, 225, 226, 291, 315/299, 307, 308, 312, DIG. 7, 244
See application file for complete search history.

(56) References Cited

U.S. PATENT DOCUMENTS

| | | | | |
|---|---|---|---|---|
| 4,870,327 | A * | 9/1989 | Jorgensen | 315/307 |
| 6,392,364 | B1 * | 5/2002 | Yamamoto et al. | 315/291 |
| 6,693,393 | B2 * | 2/2004 | Konishi et al. | 315/224 |
| 7,239,091 | B2 * | 7/2007 | Shinmen et al. | 315/224 |
| 7,291,990 | B2 * | 11/2007 | Ichikawa et al. | 315/291 |
| 2003/0122506 | A1 * | 7/2003 | Kamata et al. | 315/291 |

* cited by examiner

*Primary Examiner*—Haissa Philogene
(74) *Attorney, Agent, or Firm*—Nixon Peabody LLP

(57) ABSTRACT

A lamp driving circuit includes a step-up transformer, a detector, and a controller. The step-up transformer includes a primary winding, and a secondary winding configured to cooperate with a discharge lamp to form a tank circuit that generates a tank current. The detector is adapted for detecting current magnitude of current flowing through the discharge lamp, and outputs a detecting signal corresponding to the current magnitude. The controller receives the detecting signal from the detector, and generates a drive signal for driving the step-up transformer. The controller includes a capacitor, and configures a waveform of the drive signal by controlling charging of the capacitor based on a calculation value that corresponds to a frequency of the drive signal, a start-setting value, and a difference between the detecting signal and a current-setting signal.

17 Claims, 11 Drawing Sheets

LAMP DRIVING CIRCUIT FOR A DISCHARGE LAMP AND A CONTROL METHOD THEREOF

CROSS-REFERENCE TO RELATED APPLICATION

This application claims priority of Taiwanese Application No. 095128662, filed on Aug. 4, 2006.

BACKGROUND OF THE INVENTION

1. Field of the Invention

The invention relates to a lamp driving circuit and a control method thereof, more particularly to a lamp driving circuit adapted for a discharge lamp and a control method thereof.

2. Description of the Related Art

In recent years, as discharge lamps, such as hot cathode fluorescent lamps, cold cathode fluorescent lamps, external electrode fluorescent lamps, neon lamps, etc., become widely used in backlight systems of liquid crystal display devices, advertisement displaying devices, and general lighting devices, etc., it is increasingly important for lamp driving circuits that convert direct-current (DC) power to alternating-current (AC) power for driving the discharge lamps to be compact and highly efficient.

As shown in FIG. 1, a conventional drive circuit is adapted for driving at least one discharge lamp 74. When the conventional drive circuit is adapted for driving a plurality of the discharge lamps 74, the discharge lamps 74 need to be connected in parallel to each other. The following description is presented using an example where the conventional drive circuit is adapted for driving a single discharge lamp 74.

The conventional discharge lamp includes a step-up transformer 71, a detector 72, and a controller 73.

The step-up transformer 71 includes a primary winding 711 and a secondary winding 712. The secondary winding 712 is adapted to be coupled electrically to the discharge lamp 74, and is adapted to cooperate with the discharge lamp 74 to form a tank circuit that generates a tank current. The tank circuit is composed of leakage inductance 716 of the secondary winding 712, distributed capacitance of the secondary winding 712, stray capacitance around the discharge lamp 74, and a suitably added auxiliary capacitance 75.

Resonance frequency of the tank circuit can be calculated using the equation below:

$$f_r = \frac{1}{2\pi\sqrt{L_s(C_w + C_a + C_s)}}$$

where $f_r$ denotes the resonance frequency of the tank circuit, $L_s$ denotes the leakage inductance 716 of the secondary winding 712, $C_w$ denotes the distributed capacitance of the secondary winding 712, $C_s$ denotes the stray capacitance around the discharge lamp 74, and $C_a$ denotes the auxiliary capacitance 75.

There are two conditions for increasing the efficiency of the conventional drive circuit, one of which is for a phase difference between a voltage and a current of the primary winding 711 of the step-up transformer 71 to approach zero, and the other one of which is to drive the step-up transformer 71 near or below the resonance frequency.

The detector 72 is for detecting phase of the tank current, current magnitude of the discharge lamp 74, and voltage magnitude of the secondary winding 712 of the step-up transformer 71, and outputs a first detecting signal corresponding to the phase of the tank current, a second detecting signal corresponding to the current magnitude of the discharge lamp 74, and a third detecting signal corresponding to the voltage magnitude of the secondary winding 712.

The detector 72 utilizes a Zener diode 721, which is connected in series to the auxiliary capacitance 75, and whose anode is grounded, to detect the phase of the tank current, so as to obtain the first detecting signal. With reference to FIG. 2, a set of example waveforms are shown, where waveform 801 represents the tank current, and waveform 802 represents the first detecting signal, the horizontal axis denoting a time axis (t).

Referring back to FIG. 1, the controller 73 is coupled electrically to the detector 72 and the primary winding 711 of the step-up transformer 71, and includes a switching unit 731, an analog-to-digital converting unit 732, an oscillator unit 733, a processing unit 734, a burst unit 735, and a waveform generating unit 736.

The switching unit 731 is coupled electrically to the primary winding 711 of the step-up transformer 71, and to the waveform generating unit 736 for receiving a control signal therefrom. The switching unit 731 further receives a direct-current (DC) power signal from a DC power source, and generates a drive signal for driving the step-up transformer 71 from the DC power signal based on the control signal. The drive signal is a periodic alternating-current (AC) signal.

The switching unit 731 is a full bridge circuit, and includes four switches, namely a first switch 761, a second switch 762, a third switch 763, and a fourth switch 764. The first switch 761 is coupled electrically between a first end of the primary winding 711 and ground, the second switch 762 is coupled electrically between the first end of the primary winding 711 and the DC power source, the third switch 763 is coupled electrically between a second end of the primary winding 711 and ground, and the fourth switch 764 is coupled electrically between the second end of the primary winding 711 and the DC power source. The control signal includes a set of control sub-signals that respectively correspond to the first to fourth switches 761~764.

Waveforms of the control sub-signals for the first to fourth switches 761~764 of the switching unit 731, of the drive signal provided to the primary winding 711 of the step-up transformer 71, and of current flowing through the primary winding 711 in a situation where a phase difference between the current flowing through the primary winding 711 and voltage across the primary winding 711 is zero, are shown in FIG. 3, the horizontal axis denoting a time axis (t). Waveforms 811~814 respectively represent the control sub-signals for the first to fourth switches 761~764, waveform 815 represents the drive signal, and waveform 816 represents the current flowing through the primary winding 711, where $T_{drive}$ denotes a period of the drive signal, $T_{duty}$ denotes a duration of a positive pulse or a negative pulse of the drive signal, and $T_{overlap}$ denotes a discharge duration to release energy stored by the primary winding 711. It should be noted herein that since $T_{overlap}$ is much smaller than $T_{drive}$, $T_{overlap}$ is enlarged in FIG. 3 for illustrative purposes.

High voltage levels of the waveforms 811~814 respectively represent closing (i.e., a conducting state) of the first to fourth switches 761~764, while low voltage levels of the waveforms 811~814 respectively represent opening (i.e., a non-conducting state) of the first to fourth switches 761~764. The positive and negative pulses of the drive signal have an absolute voltage magnitude equal to that of the DC power signal. A positive peak of the current flowing through the primary winding 711 of the step-up transformer 71 corresponds in time to a center point of the positive pulse of the drive signal, while a negative peak of the current flowing through the primary winding 711 corresponds in time to a center point of the negative pulse of the drive signal.

The phase difference between the current flowing through the primary winding 711 and the voltage across the primary winding 711 can be adjusted by adjusting $T_{drive}$. Current flowing through the discharge lamp 74 can be adjusted by adjusting $T_{duty}$, where $T_{duty}$ is adjusted by varying duration of the positive/negative pulse of the drive signal in equal-amounts to the left and right with respect to a center of the positive/negative pulse. Since the first switch 761 and the third switch 763 are disposed in the conducting state simultaneously for a period of time (i.e., during $T_{overlap}$), both the first and second ends of the primary winding 711 are grounded simultaneously, and energy stored by the primary winding 711 can be discharged to facilitate reversal of the direction of the current flowing through the primary winding 711. $T_{overlap}$ needs to be large enough for the primary winding 711 to be sufficiently discharged. Discharging of the primary winding 711 can also be achieved by closing the second switch 762 and the fourth switch 764 simultaneously such that the two ends of the primary winding 711 are coupled electrically and simultaneously to the DC power source.

A duty ratio of the drive signal is calculated as follows:

$$R_{duty} = \frac{2 \cdot T_{duty}}{\cdot T_{drive}} \times 100\%$$

where $R_{duty}$ denotes the duty ratio of the drive signal, $T_{drive}$ denotes the period of the drive signal, and $T_{duty}$ denotes the duration of the positive pulse or the negative pulse of the drive signal.

The larger the duty ratio of the drive signal, the larger will be the current flowing through the discharge lamp 74 is.

Referring back to FIG. 1, the analog-to-digital converting unit 732 is coupled electrically to the detector 72 for receiving the second detecting signal and the third detecting signal therefrom, and further receives a first burst signal (i.e., a DC voltage signal) from an external source. The analog-to-digital converting unit 732 converts the second detecting signal, the third detecting signal and the first burst signal respectively into corresponding digital values, namely a second detecting value, a third detecting value, and a first burst value.

The oscillator unit 733 generates an oscillating signal having a frequency larger than that of the drive signal.

The processing unit 734 is coupled electrically to the detector 72 for receiving the first detecting signal therefrom, and to the analog-to-digital converting unit 732 for receiving the second detecting value and the third detecting value therefrom. The processing unit 734 records a first calculation value, a second calculation value, a third calculation value, a current-setting value, and a voltage-setting value.

The first, second and third calculation values are defined by the following relations:

$$N_1 = \frac{T_{drive}}{T_{osc}}$$

$$N_2 = \frac{T_{duty}}{T_{osc}}$$

$$N_3 = \frac{T_{overlap}}{T_{osc}}$$

wherein $N_1$ denotes the first calculation value, $N_2$ denotes the second calculation value, $N_3$ denotes the third calculation value, $T_{drive}$ denotes the period of the drive signal, $T_{duty}$ denotes the duration of the positive pulse or the negative pulse of the drive signal, $T_{overlap}$ denotes the discharge duration to release energy stored by the primary winding 711, and $T_{osc}$ denotes a period of the oscillating signal. The first to third calculation values and the oscillating signal are used to configure the waveform of the drive signal.

The first calculation value $N_1$ has a preset value. The processing unit 734 gradually adjusts the first calculation value $N_1$ from the preset value according to the first detecting signal received from the detector 72, such that a phase difference between the drive signal and the tank current is zero. At this time, the step-up transformer 71 is driven near the resonance frequency. Detailed description relating to the adjustment of the first calculation value $N_1$ will be provided in the following paragraph.

The processing unit 734 determines voltage level of the first detecting signal upon switching of the third switch 763 of the switching unit 731 from the non-conducting state to the conducting state. When the first detecting signal is at a high voltage level, which indicates that the phase of the drive signal leads the phase of the tank current, the processing unit 734 increases the first calculation value $N_1$ so as to delay the phase of the drive signal. On the other hand, when the first detecting signal is at a low voltage level, which indicates that the phase of the drive signal lags the phase of the tank current, the processing unit 734 reduces the first calculation value $N_1$ so as to advance the phase of the drive signal.

The current-setting value is determined by the user. The processing unit 734 adjusts the second calculation value $N_2$ and the third calculation value $N_3$ according to a first difference between the second detecting value and the current-setting value as determined by the processing unit 734, so as to make the current flowing through the discharge lamp 74 correspond to the current-setting value. When the first difference indicates that the second detecting value is smaller than the current-setting value, the second calculation value $N_2$ and the third calculation value $N_3$ are increased by the processing unit 734. On the other hand, when the first difference indicates that the second detecting value is larger than the current-setting value, the second calculation value $N_2$ and the third calculation value $N_3$ are decreased by the processing unit 734.

The voltage-setting value is also determined by the user. The processing unit 734 determines whether the voltage of the secondary winding 712 of the step-up transformer 71 is normal by determining a second difference between the third detecting value and the voltage-setting value. When the second difference indicates that the third detecting value is greater than the voltage-setting value, which indicates that the voltage of the secondary winding 712 is too large, a warning signal is outputted by the processing unit 734 so as to protect the drive circuit and the discharge lamp 74.

The burst unit 735 is coupled electrically to the oscillator unit 733 for receiving the oscillating signal therefrom, to the analog-to-digital converting unit 732 for receiving the first burst value, and to the processing unit 734 for receiving the warning signal therefrom. The burst unit 735 further receives a second burst signal and a select signal from an external source. Frequency of the second burst signal is smaller than that of the drive signal, and timing of the high voltage level (or low voltage level) of the second burst signal is adjustable. The burst unit 735 conducts frequency division of the oscillating signal so as to generate a third burst signal, whose timing of high voltage level (or low voltage level) corresponds to that of the first burst value, and whose frequency is smaller than that of the drive signal. The burst unit 735 further outputs one of the second and third burst signals as a burst control signal according to the select signal. The burst unit 735 stops operating upon receipt of the warning signal.

The waveform generating unit 736 is coupled electrically to the oscillator unit 733 for receiving the oscillating signal therefrom, to the processing unit 734 for receiving the first to third calculation values $N_1$, $N_2$, $N_3$, and the warning signal therefrom, and to the burst unit 735 for receiving the burst control signal therefrom. The waveform generating unit 736 configures the waveforms of the control sub-signals for the first to fourth switches 761~764 of the switching unit 731, such as the waveforms 811~814 shown in FIG. 3, according to the first to third calculation values $N_1$, $N_2$, $N_3$ by counting the oscillating signal. The waveform generating unit 736 outputs the control signal, including the set of control sub-signals, to the switching unit 731 when the burst control signal is at one of a high voltage level and a low voltage level, and does not output the control signal to the switching unit 731 when the burst control signal is at the other one of the high voltage level and the low voltage level. The waveform generating unit 736 stops operating upon receipt of the warning signal.

As shown in FIG. 1, the burst control signal outputted by the burst unit 735 and the current-setting value recorded by the processing unit 734 cooperate to adjust the average current flowing through the discharge lamp 74 so as to adjust the brightness of light provided by the discharge lamp 74, thereby achieving light adjustment of the discharge lamp 74.

It should be noted herein that the processing unit 734 can also gradually adjust the first calculation value $N_1$ according to the first detecting signal such that the phase difference between the drive signal and the tank current can be non-zero (detailed description of which will be provided in the following paragraph). At this time, the step-up transformer 71 is driven near, below, or above the resonance frequency.

In order to permit the phase difference between the drive signal and the tank current to be non-zero, the processing unit 734 further records a phase-setting value that is determined by the user, and further receives the oscillating signal from the oscillator unit 733 (connection between the oscillating unit 733 and the processing unit 734 is not shown in FIG. 1). The processing unit 734 delays the timing of determining the voltage level of the first detecting signal with reference to the phase-setting value by counting the oscillating signal. In particular, the timing of determining the voltage level of the first detecting signal is delayed by a duration of the phase-setting value multiplied by the period of the oscillating signal $T_{osc}$.

Referring to FIG. 4, waveform 821 represents the control sub-signal for the third switch 763 of the switching unit 731, and waveform 822 represents the first detecting signal. When the phase-setting value is smaller than the first calculation value $N_1$, the phase difference between the drive signal and the tank current is less than zero. The step-up transformer 71 is driven at a frequency above the resonance frequency.

Referring to FIG. 5, waveform 831 represents the control sub-signal for the third switch 763 of the switching unit 731, and waveform 832 represents the first detecting signal. When the phase-setting value is greater than the first calculation value $N_1$, the phase difference between the drive signal and the tank current is greater than zero. The step-up transformer 71 is driven at a frequency below the resonance frequency.

When the phase-setting value is equal to the first calculation value, the phase difference between the drive signal and the tank current is zero. The step-up transformer 71 is driven near the resonance frequency.

The conventional drive circuit automatically adjusts the frequency of the drive signal according to the phase of the tank current, such that the frequency of the drive signal changes with variations of the resonance frequency (e.g., caused by variations in the stray capacitance around the discharge lamp 74), so as to reduce efficiency differences among different conventional drive circuits during mass production.

However, since the waveform of the drive signal is configured by a digital control method in the conventional drive circuit, the smallest variation gradient in $T_{duty}$ is $T_{osc}$. When $T_{duty}$ changes, since the variation thereof is not continuous, but in steps of multiples of $T_{osc}$, the brightness of the light provided by the discharge lamp 74 changes abruptly (discontinuous), resulting in flashing of the light provided by the discharge lamp 74.

Moreover, since $T_{duty}$ is adjusted by first converting the second detecting signal that corresponds to the current magnitude of the current flowing through the discharge lamp 74 into the corresponding digital second detecting value, and then by determining the first difference between the second detecting value and the current-setting value, and since a time lag exists between the second detecting value and the second detecting signal due to analog-to-digital conversion, adjustment of $T_{duty}$ by the conventional drive circuit is not in real time, which easily results in malfunctioning of the conventional drive circuit or instability in the brightness of the light provided by the discharge lamp 74.

SUMMARY OF THE INVENTION

Therefore, the object of the present invention is to provide a lamp driving circuit for a discharge lamp that incorporates digital control and analog light adjustment.

Another object of the present invention is to provide a control method implemented by a lamp driving circuit for a discharge lamp that incorporates digital control and analog light adjustment.

According to one aspect of the present invention, there is provided a lamp driving circuit that is adapted for driving at least one discharge lamp. The lamp driving circuit includes a step-up transformer, a detector, and a controller. The step-up transformer includes a primary winding, and a secondary winding adapted to be coupled electrically to the discharge lamp and adapted to cooperate with the discharge lamp to form a tank circuit that generates a tank current. The detector is adapted for detecting current magnitude of current flowing through the discharge lamp, and outputs a detecting signal that corresponds to the current magnitude detected thereby. The controller is coupled electrically to the primary winding of the step-up transformer, and to the detector for receiving the detecting signal therefrom. The controller generates a drive signal for driving the step-up transformer.

The controller includes a capacitor, and further receives a current-setting signal. The controller configures a waveform of the drive signal by controlling charging of the capacitor based on a calculation value that corresponds to a frequency of the drive signal, a start-setting value, and a difference between the detecting signal and the current-setting signal.

According to another aspect of the present invention, there is provided a control method to be implemented using a lamp driving circuit that is adapted for driving at least one discharge lamp, and that includes a step-up transformer. The step-up transformer includes a primary winding and a secondary winding adapted to be coupled electrically to the discharge lamp and adapted to cooperate with the discharge lamp to form a tank circuit that generates a tank current.

The control method includes the steps of: detecting current magnitude of current flowing through the discharge lamp, and outputting a detecting signal that corresponds to the current magnitude thus detected; and configuring a waveform of a drive signal used to drive the step-up transformer by controlling charging of a capacitor based on a calculation value that corresponds to a frequency of the drive signal, a start-setting value, and a difference between the detecting signal and a current-setting signal.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
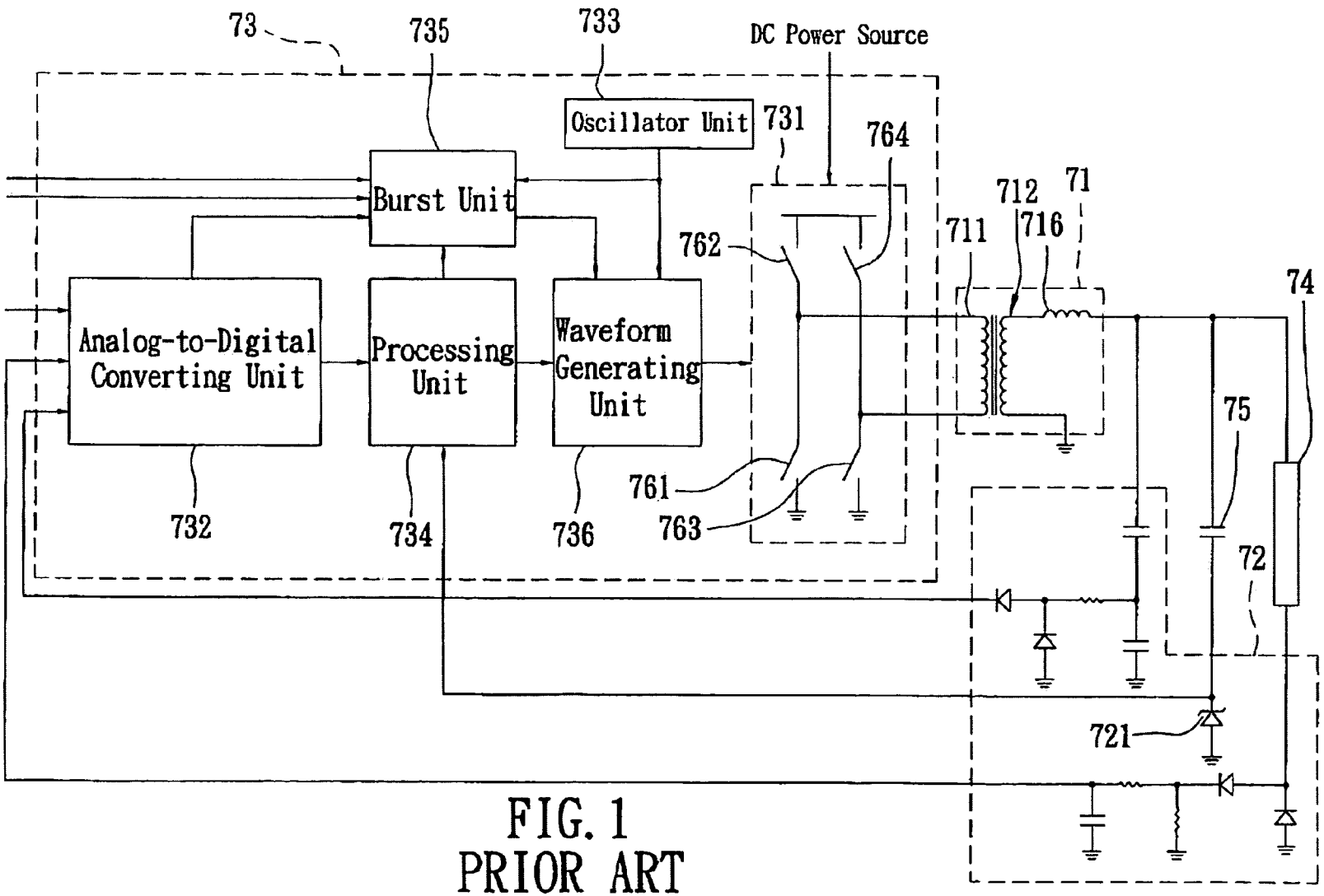
FIG. 1 PRIOR ART
FIG. 1 is a circuit block diagram of a conventional drive circuit adapted for driving a discharge lamp.
Figure 2:
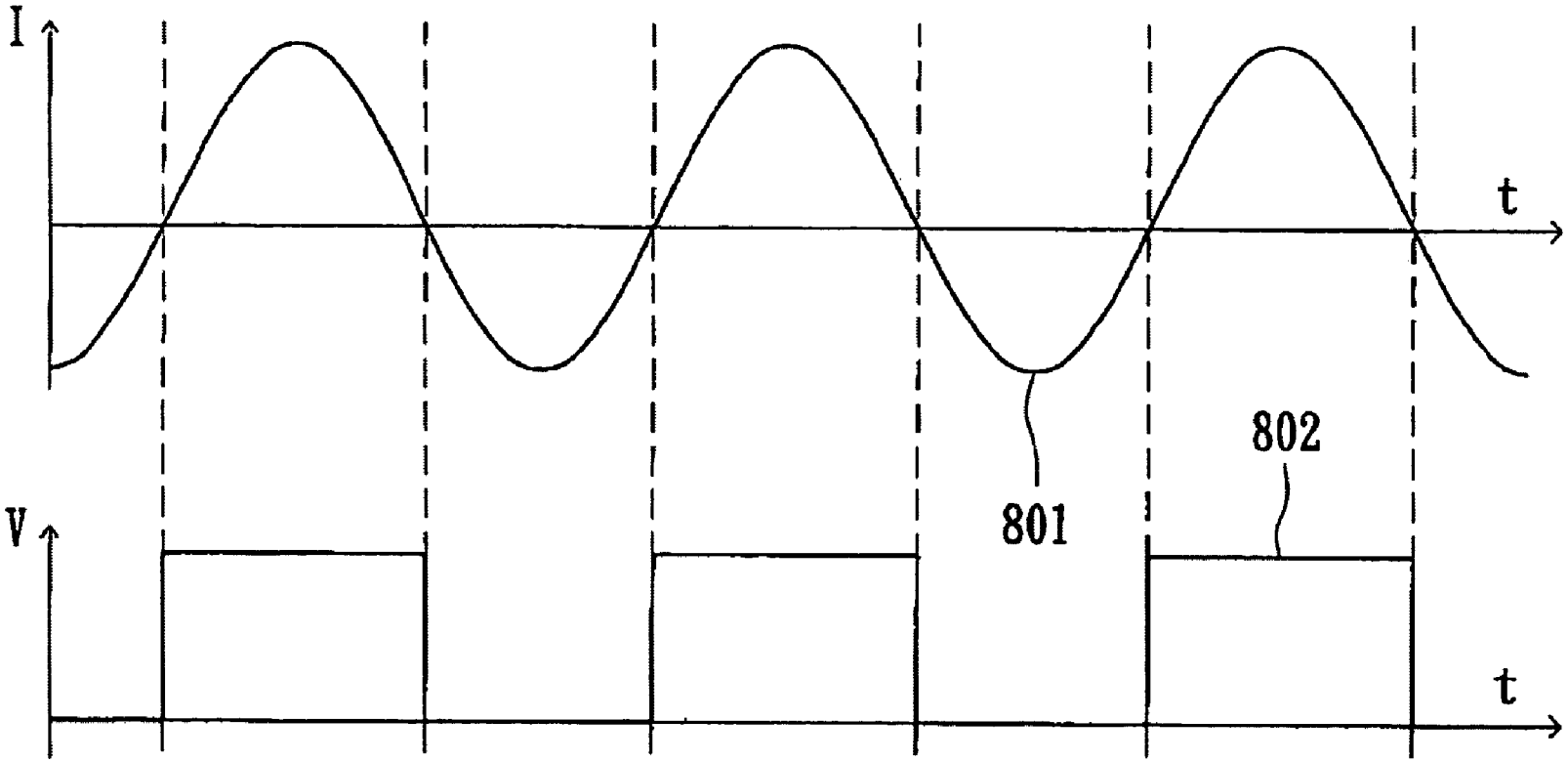
FIG. 2 PRIOR ART
FIG. 2 is a timing diagram, illustrating waveforms of a tank current and a first detecting signal in the conventional drive circuit.
Figure 3:
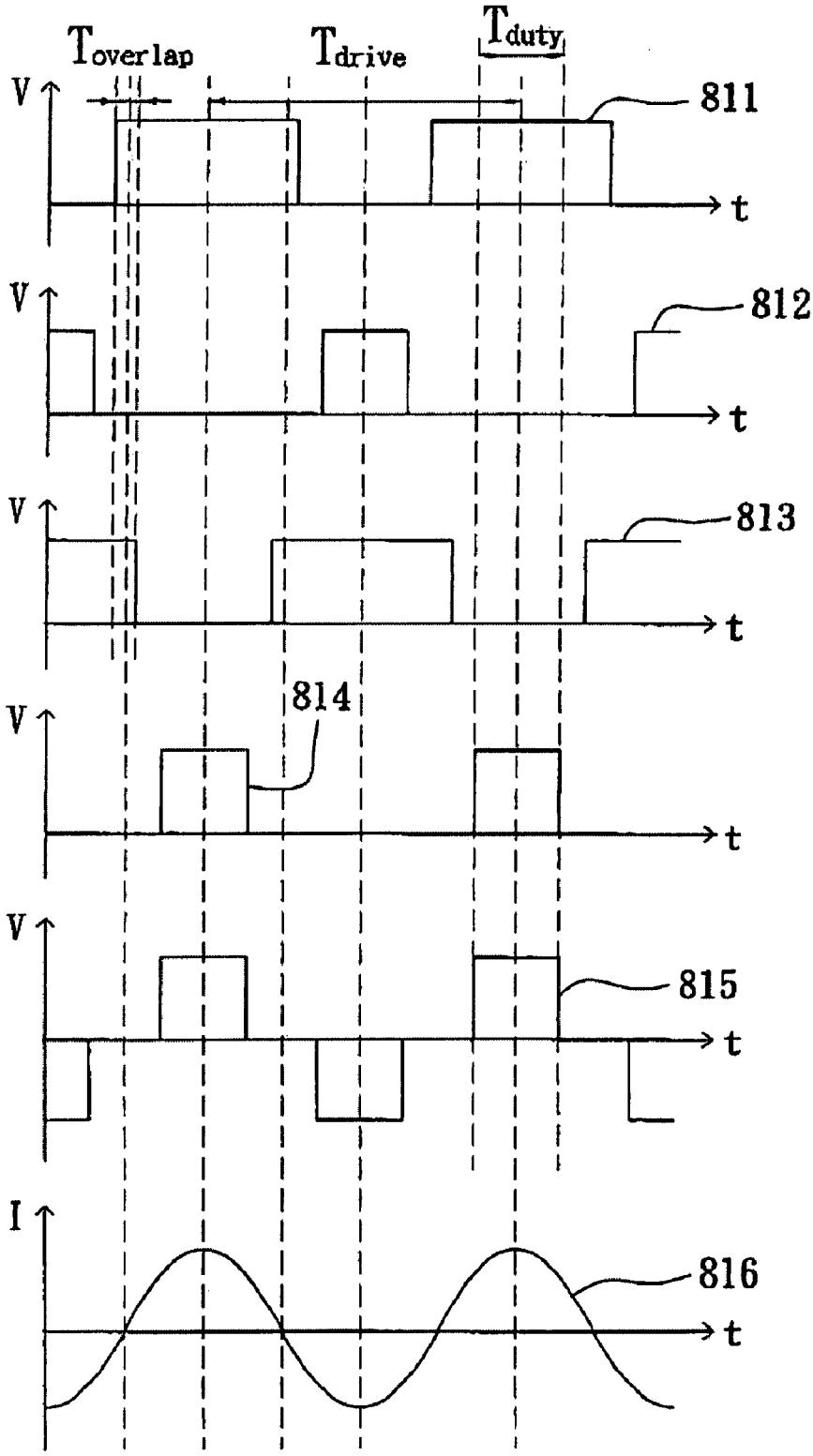
FIG. 3 PRIOR ART
FIG. 3 is a timing diagram, illustrating waveforms of a set of control sub-signals, a drive signal, and current flowing through a primary winding in the conventional drive circuit.
Figure 4:
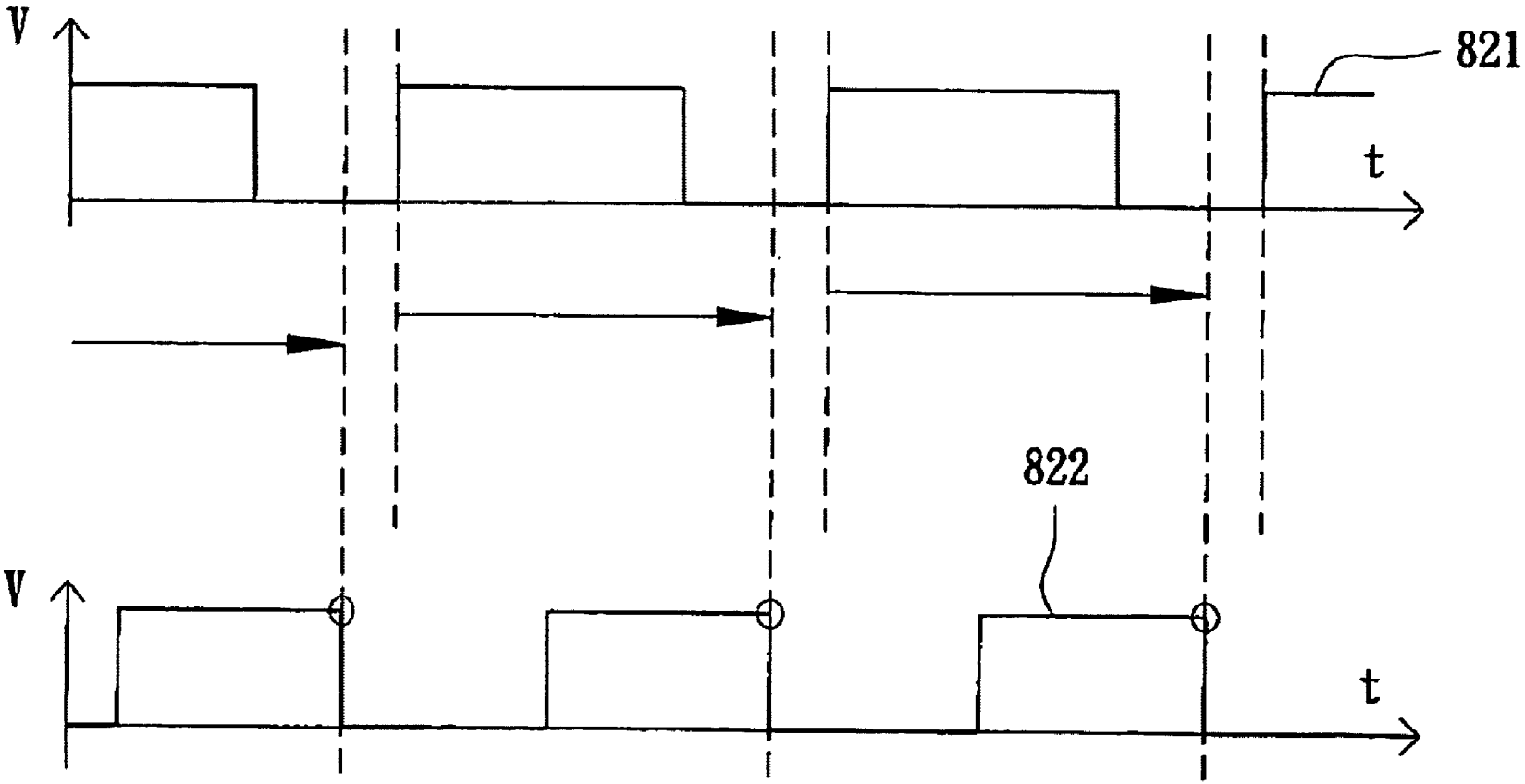
FIG. 4 PRIOR ART
FIG. 4 is a timing diagram, illustrating waveforms of the control sub-signal corresponding to a third switch and the first detecting signal in the conventional drive circuit in a situation where a phase-setting value is smaller than a first calculation value.
Figure 5:
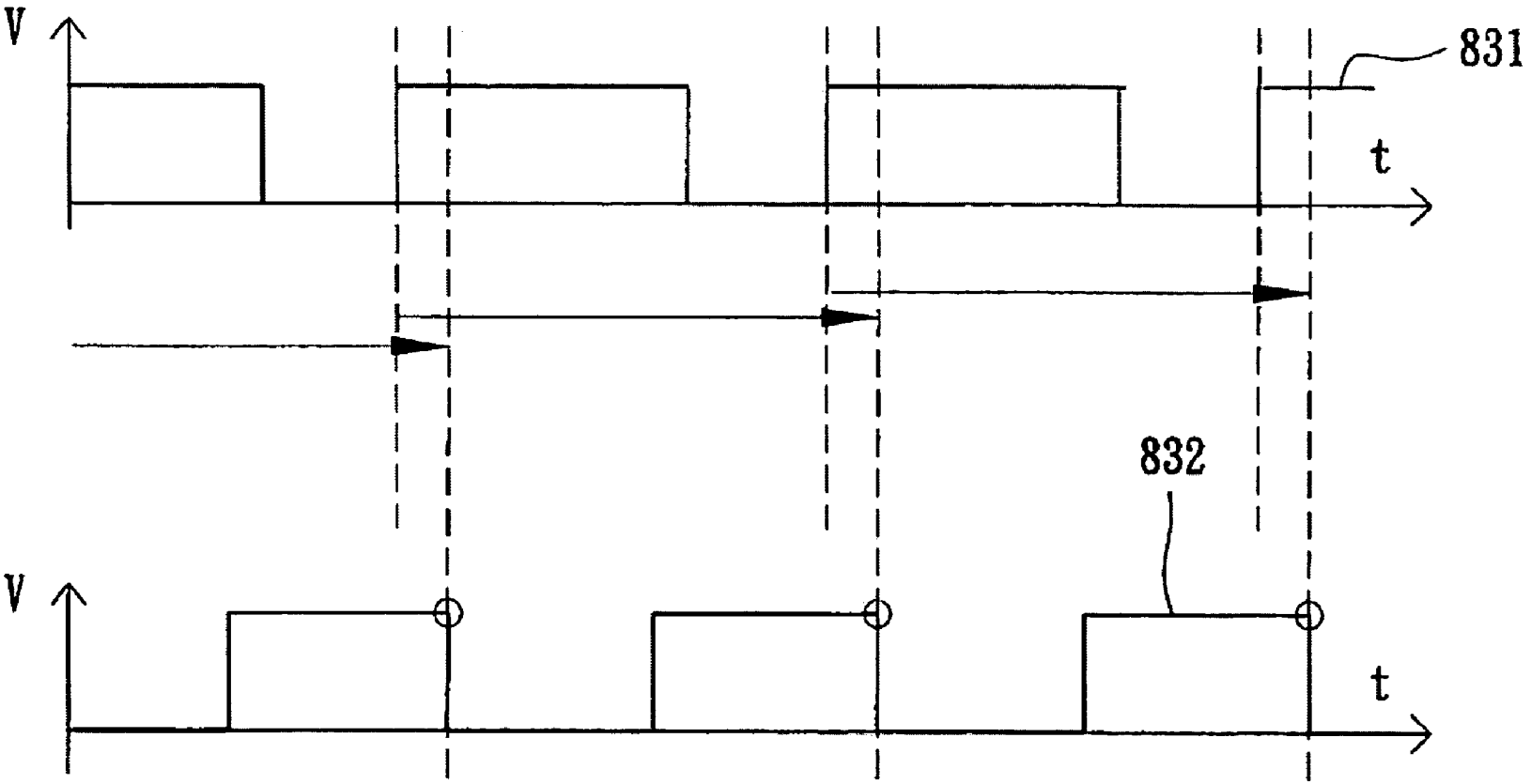
FIG. 5 PRIOR ART
FIG. 5 is a timing diagram, illustrating waveforms of the control sub-signal corresponding to the third switch and the first detecting signal in the conventional drive circuit in a situation where the phase-setting value is greater than the first calculation value.

Before the present invention is described in greater detail, it should be noted that like elements are denoted by the same reference numerals throughout the disclosure.

Figure 6:
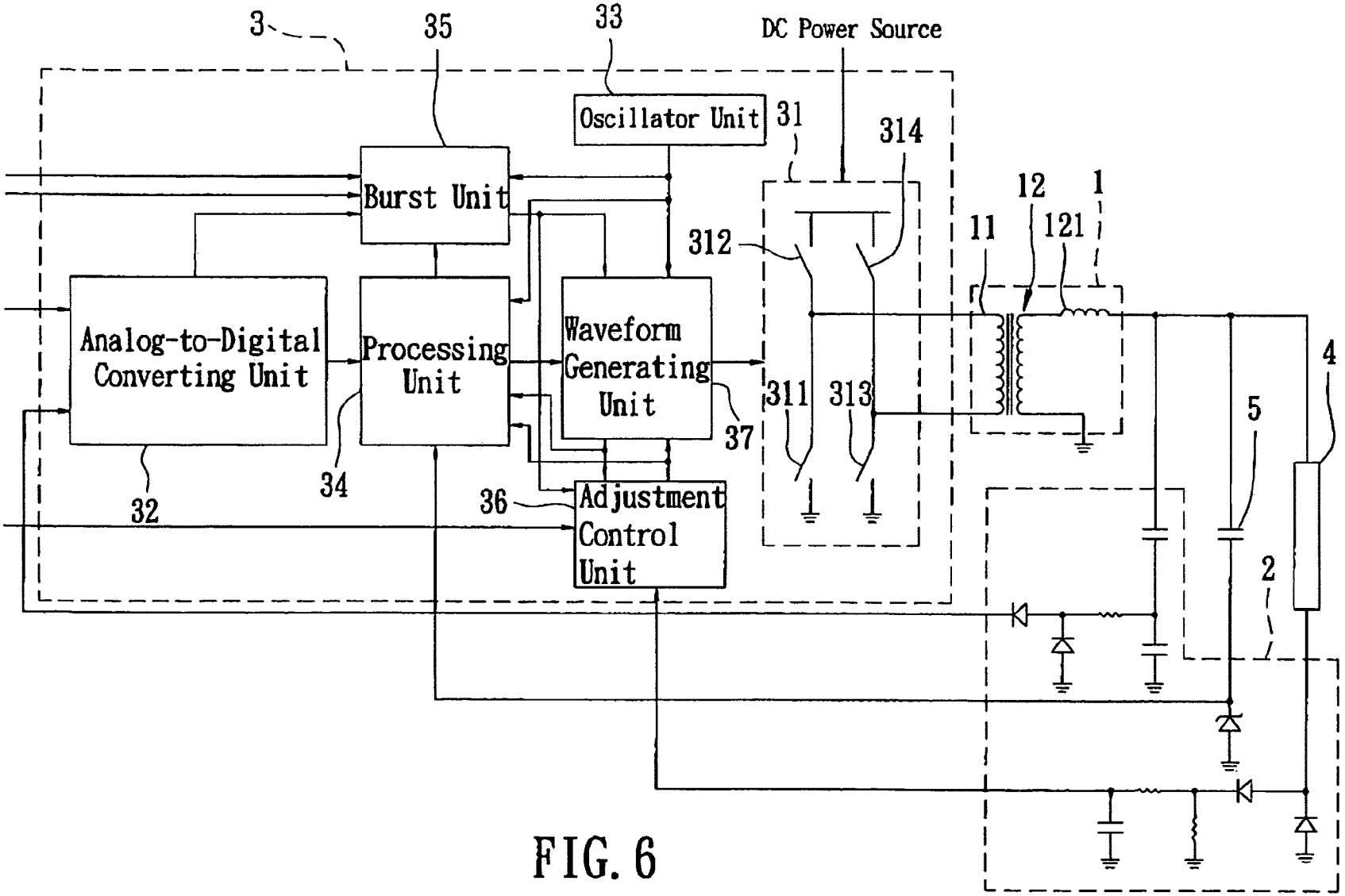
FIG. 6 is a circuit block diagram, illustrating the first preferred embodiment of a lamp driving circuit according to the present invention.

As shown in FIG. 6, a lamp driving circuit according to the present invention is adapted for driving at least one discharge lamp 4. When the lamp driving circuit is for driving a plurality of the discharge lamps 4, the discharge lamps 4 need to be connected in parallel. The following description is presented using an illustrative example where the lamp driving circuit drives a single discharge lamp 4.

The first preferred embodiment of a lamp driving circuit according to the present invention includes a step-up transformer 1, a detector 2, and a controller 3.

The step-up transformer 1 includes a primary winding 11, and a secondary winding 12 adapted to be coupled electrically to the discharge lamp 4 and adapted to cooperate with the discharge lamp 4 to form a tank circuit that generates a tank current. More particularly, the tank current is generated by resonance among distributed capacitance of the secondary winding 12, stray capacitance around the discharge lamp 4, a suitably added auxiliary capacitance 5, and leakage inductance 121 of the secondary winding 12.

The detector 2 is adapted for detecting current magnitude of current flowing through the discharge lamp 4, and outputs a first detecting signal that corresponds to the current magnitude detected thereby. In this embodiment, the detector 2 is further adapted to detect phase of the tank current and voltage magnitude of voltage of the secondary winding 12, and further outputs a second detecting signal that corresponds to the phase of the tank current, and a third detecting signal that corresponds to the voltage magnitude of the voltage of the secondary winding 12.

Figure 8:
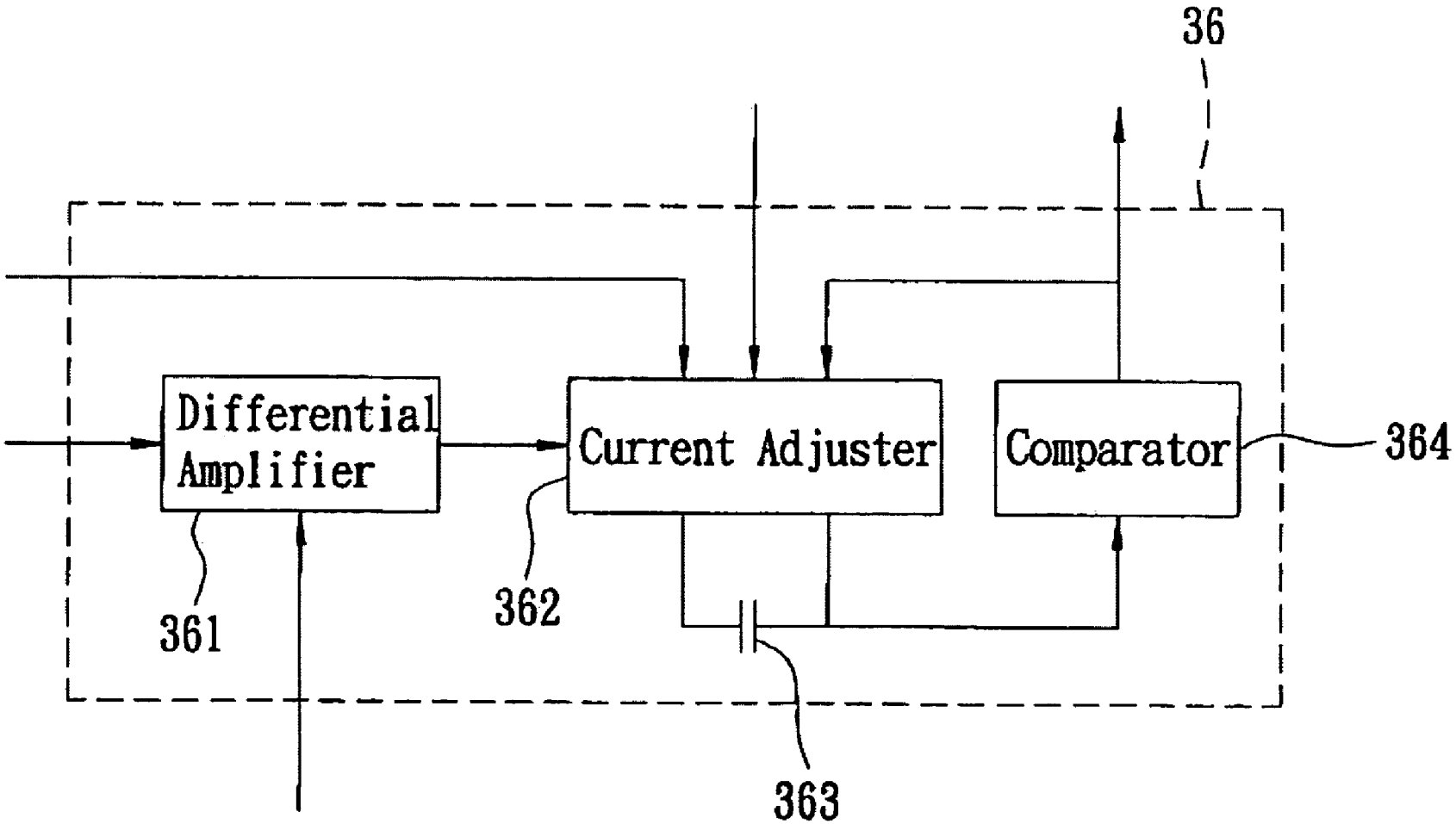
FIG. 8 is a circuit block diagram of a first implementation of an adjustment control unit of the first preferred embodiment.

The controller 3 is coupled electrically to the primary winding 11 of the step-up transformer 1, and to the detector 2 for receiving the first detecting signal therefrom. The controller 3 generates a drive signal for driving the step-up transformer 1. Referring to FIG. 8, the controller 3 includes a capacitor 363, and further receives a current-setting signal. The controller 3 configures a waveform of the drive signal by controlling charging of the capacitor 363 based on a first calculation value that corresponds to a frequency of the drive signal, a start-setting value, and a difference between the first detecting signal and the current-setting signal. In this embodiment, start of the charging of the capacitor 363 is controlled according to the start-setting value, and a charging period of the capacitor 363 is controlled according to the difference between the first detecting signal and the current-setting signal duty ratio of the drive signal corresponds to the charging period of the capacitor 363.

In this embodiment, the controller 3 further receives the second detecting signal from the detector 2, and adjusts the first calculation value according to the second detecting signal. Preferably, the controller 3 adjusts the first calculation value such that a phase difference between the drive signal and the tank current is approximately zero. Preferably, the controller 3 further determines a phase difference between the drive signal and the tank current with reference to a phase-setting value. In addition, the controller 3 outputs an abnormal signal when the charging period of the capacitor 363 exceeds a reasonable range.

Referring once again to FIG. 6, according to the first preferred embodiment of the present invention, the controller 3 includes a switching unit 31, an analog-to-digital converting unit 32, an oscillator unit 33, a processing unit 34, a burst unit 35, a waveform generating unit 37, and an adjustment control unit 36. The switching unit 31 is coupled electrically to the primary winding 11 of the step-up transformer 1, and to the waveform generating unit 37 for receiving a control signal therefrom. The switching unit 31 further receives a direct-current (DC) power signal from a DC power source, and generates the drive signal for driving the step-up transformer 1 from the direct-current power signal based on the control signal. The drive signal is a periodic alternating-current (AC) signal.

In this embodiment, the switching unit 31 is a full bridge circuit, includes four switches, namely a first switch 311, a second switch 312, a third switch 313, and a fourth switch 314. In addition, the control signal includes a set of control sub-signals that respectively correspond to the first to fourth switches 311~314. The first switch 311 is coupled electrically between a first end of the primary winding 11 and ground. The second switch 312 is coupled electrically between the first end of the primary winding 11 and the DC power source. The third switch 313 is coupled electrically between a second end of the primary winding 11 and ground. The fourth switch 314 is coupled electrically between the second end of the primary winding 11 and the DC power source.

Figure 7:
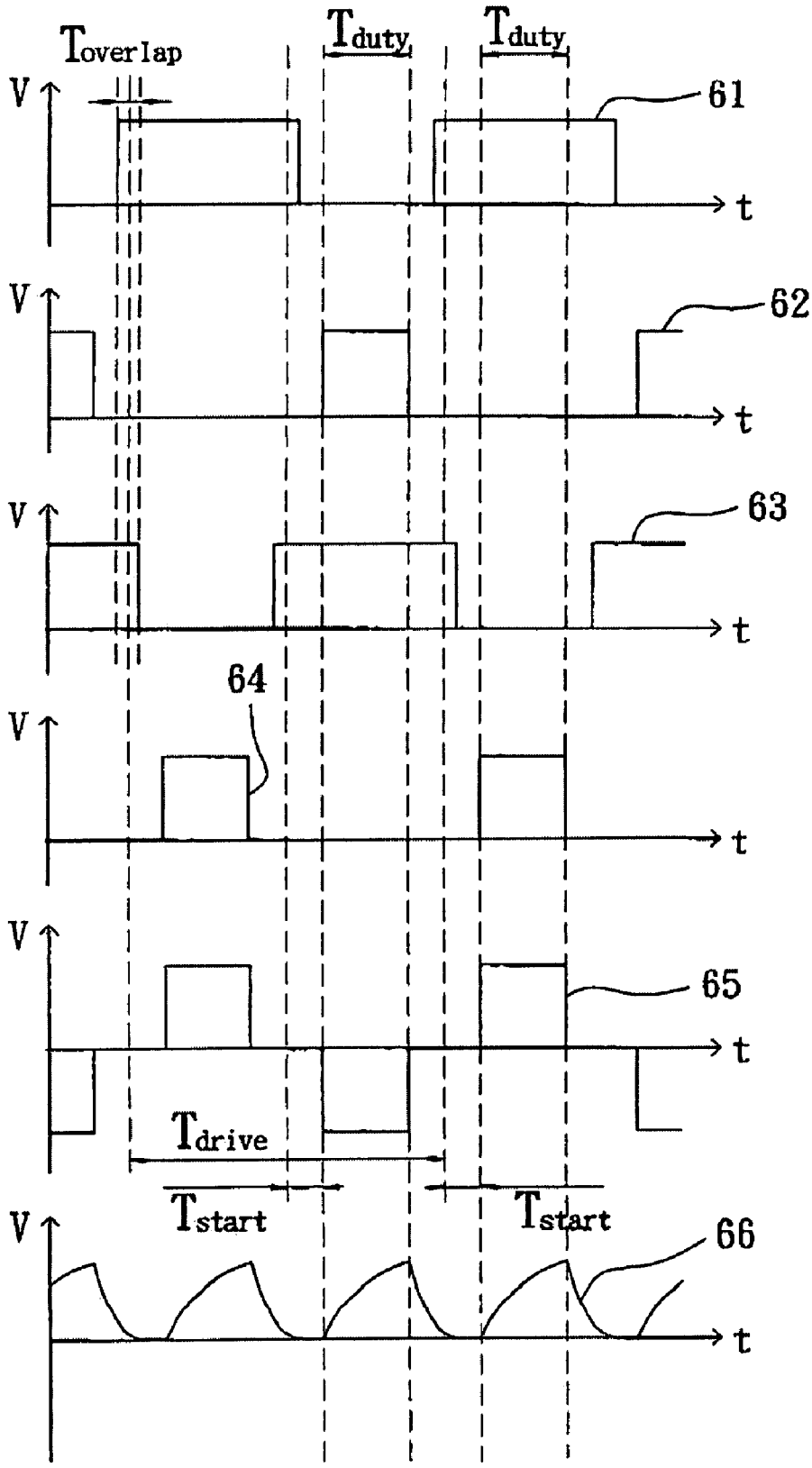
FIG. 7 is a timing diagram, illustrating waveforms of a set of control sub-signals, a drive signal, and voltage across a capacitor in the first preferred embodiment.

Example waveforms of the control sub-signals for controlling opening and closing of the first to fourth switches 311~314, and of the drive signal generated by the switching unit 31 are shown in FIG. 7, the horizontal axis denoting a time axis (t). In FIG. 7, waveforms 61~64 respectively represent control sub-signals for the first to fourth switches 311~314, and waveform 65 represents the drive signal, where $T_{drive}$ denotes a period of the drive signal, $T_{start}$ denotes lag of positive or negative pulses of the drive signal from a start of a half period of the drive signal, $T_{duty}$ denotes duration of the positive or negative pulses of the drive signal, and $T_{overlap}$ denotes a discharge duration to release energy stored by the primary winding 11. It should be noted herein that since $T_{overlap}$ is much smaller than $T_{drive}$, $T_{overlap}$ is enlarged in FIG. 7 for illustrative purposes.

High voltage levels of the waveforms 61~64 respectively represent closing (i.e., a conducting state) of the first to fourth switches 311~314, while low voltage levels of the waveforms 61~64 respectively represent opening (i.e., a non-conducting state) of the first to fourth switches 311~314.

The phase difference between the current flowing through the primary winding 11 and the voltage across the primary winding 11 can be adjusted by adjusting $T_{drive}$. Starting times of the positive and negative pulses of the drive signal are adjusted by adjusting $T_{start}$. Current flowing through the discharge lamp 4 can be adjusted by adjusting $T_{duty}$, where $T_{duty}$ is adjusted by varying duration of the positive/negative pulse of the drive signal from a starting time of the positive/negative pulse. Since the first switch 311 and the third switch 313 are disposed in the conducting state simultaneously for a period of time (i.e., during $T_{overlap}$), both the first and second ends of the primary winding 11 are grounded simultaneously, and energy stored by the primary winding 11 can be discharged to facilitate reversal of the direction of the current flowing through the primary winding 11. $T_{overlap}$ needs to be large enough for the primary winding 11 to be sufficiently discharged. Discharging of the primary winding 11 can also be achieved by closing the second switch 312 and the fourth switch 314 simultaneously such that the two ends of the primary winding 11 are coupled electrically and simultaneously to the DC power source.

Referring back to FIG. 6, the analog-to-digital converting unit 32 is coupled electrically to the detector 2 for receiving the third detecting signal therefrom, and further receives a first burst signal (i.e., a DC voltage signal) from an external source. The analog-to-digital converting unit 32 converts the third detecting signal and the first burst signal respectively into corresponding digital values, namely a third detecting value and a first burst value.

The oscillator unit 33 is coupled electrically to the waveform generating unit 37 and is for generating and outputting an oscillating signal to the waveform generating unit 37. Frequency of the oscillating signal is greater than frequency of the drive signal.

The processing unit 34 records the first calculation value and the start-setting value, and is coupled electrically to the waveform generating unit 37 for providing the first calculation value and the start-setting value thereto. In this embodiment, the processing unit 34 further records a voltage-setting value and an overlap-setting value, and further provides the voltage-setting value and the overlap-setting value to the waveform generating unit 37. The processing unit 34 is further coupled electrically to the detector 2 for receiving the second detecting signal therefrom, to the analog-to-digital converting unit 32 for receiving the third detecting value therefrom, and to the oscillator unit 33 for receiving the oscillating signal therefrom.

The first calculation value, the start-setting value and the overlap-setting value are defined by the following relations:

$$N_1 = \frac{T_{drive}}{T_{osc}}$$

$$N_{start} = \frac{T_{start}}{T_{osc}}$$

$$N_{overlap} = \frac{T_{overlap}}{T_{osc}}$$

wherein $N_1$ denotes the first calculation value, $N_{start}$ denotes the start-setting value, $N_{overlap}$ denotes the overlap-setting value, $T_{drive}$ denotes the period of the drive signal, $T_{start}$ denotes lag of positive or negative pulses of the drive signal from a start of a half period of the drive signal, $T_{overlap}$ denotes the discharge duration to release energy stored by the primary winding 11, and $T_{osc}$ denotes a period of the oscillating signal. The first calculation value, the start-setting value, the overlap-setting value, and the oscillating signal are used to configure the waveform of the drive signal (for example, as shown in FIG. 7 by waveform 65).

The first calculation value has a preset value. The processing unit 34 adjusts the first calculation value from the preset value according to the second detecting signal. Since the first calculation value is adjusted in the same manner as the prior art, further details of the same are omitted herein for the sake of brevity.

As with the prior art, a difference between the third detecting value and the voltage-setting value is used to determine whether the processing unit 34 needs to output a warning signal, and further details of the same are also omitted herein for the sake of brevity.

The start-setting value and the overlap-setting value are determined by the user.

The adjustment control unit 36 is coupled electrically to the detector 2 for receiving the first detecting signal therefrom, is further coupled electrically to the waveform generating unit 37 for receiving a start signal therefrom and for outputting a termination signal thereto, and includes the capacitor 363 (as shown in FIG. 8). The adjustment control unit 36 further receives the current-setting signal from the external source, controls start of the charging of the capacitor 363 based on the start signal, and controls a charging period of the capacitor 363 based on the difference between the first detecting signal and the current-setting signal. The adjustment control unit 36 outputs the termination signal upon termination of the charging of the capacitor 363.

Two implementations of the adjustment control unit 36 are presented in this text.

As shown in FIG. 6, according to a first implementation of the adjustment control unit 36, in addition to the capacitor 363, the adjustment control unit 36 further includes a differential amplifier 361, a current adjuster 362, and a comparator 364.

The differential amplifier 361 is coupled electrically to the detector 3 for receiving the first detecting signal therefrom, and further receives the current-setting signal. Each of the first detecting signal and the current-setting signal is a voltage signal in this embodiment. The differential amplifier 361 determines and amplifies the difference between the first detecting signal and the current-setting signal so as to generate a difference signal.

The current adjuster 362 is coupled electrically to the differential amplifier 361 for receiving the difference signal therefrom, is further coupled electrically to the waveform generating unit 37 for receiving the start signal therefrom, is further coupled electrically to the capacitor 363, and generates a charging current for charging the capacitor 363. The current adjuster 362 starts charging the capacitor 363 according to the start signal. The current adjuster 362 decreases the charging current when the difference signal indicates that the first detecting signal is smaller than the current-setting signal (i.e., $T_{duty}$ is too small), such that charging rate of the capacitor 363 is decreased. The current adjuster 362 increases the charging current when the difference signal indicates that the first detecting signal is greater than the current-setting signal (i.e., $T_{duty}$ is too large), such that the charging rate of the capacitor 363 is increased. The current adjuster 362 terminates the charging of the capacitor 363 and starts to discharge the capacitor 363 upon receipt of the termination signal, until a voltage across the capacitor 363 becomes zero.

The comparator 364 is coupled electrically to the capacitor 363 for comparing the voltage across the capacitor 363 with a reference voltage, and is further coupled electrically to the current adjuster 362 and the waveform generating unit 37 for generating and outputting the termination signal thereto when the voltage across the capacitor 363 is greater than the reference voltage.

Figure 9:
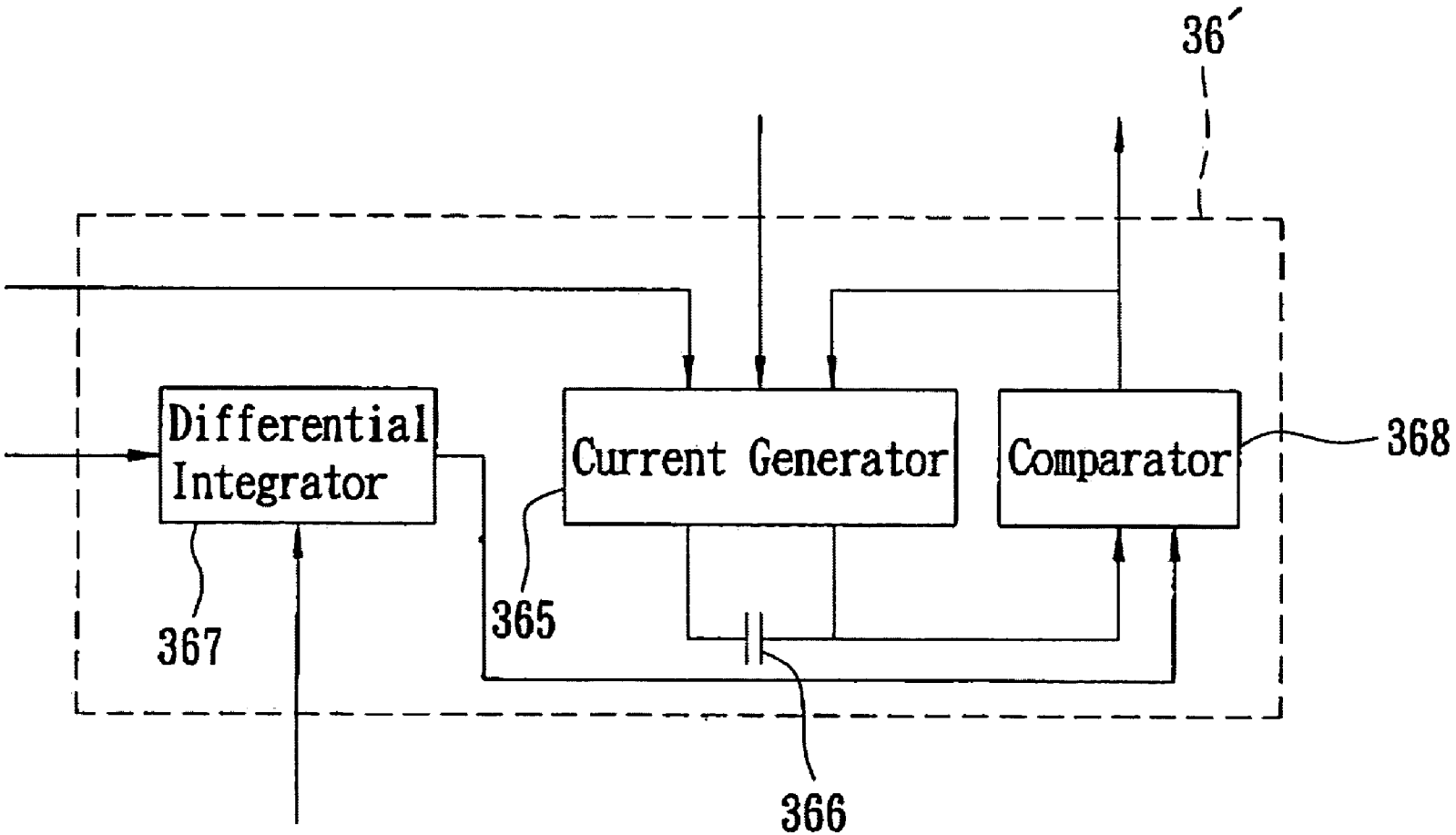
FIG. 9 is a circuit block diagram of a second implementation of the adjustment control unit of the first preferred embodiment.

As shown in FIG. 9, according to a second implementation of the adjustment control unit 36', in addition to the capacitor 366, the adjustment control unit 36 further includes a current generator 365, a differential integrator 367, and a comparator 368.

The current generator 365 is coupled electrically to the waveform generating unit 37 for receiving the start signal therefrom, is further coupled electrically to the capacitor 366, and generates a charging current for charging the capacitor 366. The current generator 365 starts charging the capacitor 363 according to the start signal, and terminates the charging of the capacitor 366 and starts to discharge the capacitor 366 upon receipt of the termination signal, until a voltage across the capacitor 366 becomes zero.

The differential integrator 367 is coupled electrically to the detector 2 for receiving the first detecting signal therefrom, and further receives the current-setting signal. Each of the first detecting signal and the current-setting signal is a voltage signal in this embodiment. The differential integrator 367 integrates and amplifies the difference between the first detecting signal and the current-setting signal so as to generate a reference voltage. The differential integrator 367 increases the reference voltage when the first detecting signal is smaller than the current-setting signal (i.e., $T_{duty}$ is too small), such that the charging period of the capacitor 366 is lengthened. The differential integrator 367 decreases the reference voltage when the first detecting signal is greater than the current-setting signal (i.e., $T_{duty}$ is too large), such that the charging period of the capacitor 366 is shortened.

The comparator 368 is coupled electrically to the differential integrator 367 for receiving the reference voltage therefrom, is further coupled electrically to the capacitor 366 for comparing the voltage across the capacitor 366 with the reference voltage, and is further coupled electrically to the current generator 365 and the waveform generating unit 37 for generating and outputting the termination signal thereto when the voltage across the capacitor 366 is greater than the reference voltage.

As shown in FIG. 7, waveform 66 represents the voltage across the capacitor 363, 366.

It should be noted herein that one end of the capacitor 363, 366 is coupled electrically to a DC voltage (not shown), which can have a value ranging from a ground voltage to the DC voltage as provided by the DC power source.

Referring back to FIG. 6 the waveform generating unit 37 receives the oscillating signal from the oscillator unit 33, receives the first calculation value, the start-setting value, the overlap-setting value and the warning signal from the processing unit 34, and receives the termination signal from the adjustment control unit 36. The waveform generating unit 37 outputs the start signal to the adjustment control unit 36, and outputs the control signal to the switching unit 31. The waveform generating unit 37 generates the start signal according to the first calculation value, the start-setting value, the overlap-setting value and the oscillating signal by counting the oscillating signal, and further generates the control signal with reference to the termination signal. The control signal is one such that a starting time for conduction of the second and fourth switches 312, 314 of the step-up transformer 31 corresponds to a starting time for charging of the capacitor 363, 366. The waveform generating unit 367 stops operating upon receipt of the warning signal.

In particular, the start-setting value and the termination signal are used to determine the duration of the positive pulse or the negative pulse of the drive signal, which is identical to the charging time of the capacitor 363, 366. In addition, the termination signal is generated as an analog signal. Consequently, the smallest variation gradient in $T_{duty}$ is not limited by the period of the oscillating signal $T_{osc}$. In other words, $T_{duty}$ can vary in a continuous manner, such that the brightness of the light provided by the discharge lamp 4 changes in a continuous manner as well.

The burst unit 35 is coupled electrically to the oscillator unit 33 for receiving the oscillating signal therefrom, to the analog-to-digital converting unit 32 for receiving the first burst value therefrom, and to the processing unit 34 for receiving the warning signal therefrom. The burst unit 35 further receives a second burst signal and a select signal from an external source. The burst unit 35 generates and outputs a burst control signal to the waveform generating unit 37. Since operation of the burst unit 35 is identical to that of the prior art, further details of the same are omitted herein for the sake of brevity.

The waveform generating unit 37 controls output of the control signal to the switching unit 31 according to the burst control signal. The burst control signal is further used to control whether the current adjuster 362 or the current generator 365 of the adjustment control unit 36, 36' is to operate. When the burst control signal is one such that the waveform generating unit 37 does not output the control signal to the switching unit 31, the current adjuster 362 or the current generator 365 of the adjustment control unit 36, 36' also stops operating, thereby avoiding ripple interference.

As shown in FIG. 6, preferably, the processing unit 34 is further coupled electrically to the adjustment control unit 36 for receiving the termination signal therefrom, and further receives the start signal from the waveform generating unit 37. The processing unit 34 generates a second calculation value based on the start signal, the termination signal and the oscillating signal, the second calculation value corresponding to the charging period of the capacitor 363, 366, which is the same as the duration of the positive pulse or negative pulse of the drive signal. The processing unit 34 outputs an abnormal signal when the charging period of the capacitor 363, 366 exceeds a reasonable range, which is indicated by the second calculation value being too large or too small.

The second calculation value is defined by the following relation:

$$N_2 = \frac{T_{duty}}{T_{osc}}$$

where $N_2$ represents the second calculation value, $T_{duty}$ denotes the duration of the positive pulse or the negative pulse of the drive signal, and $T_{osc}$ denotes the period of the oscillating signal.

Figure 10:
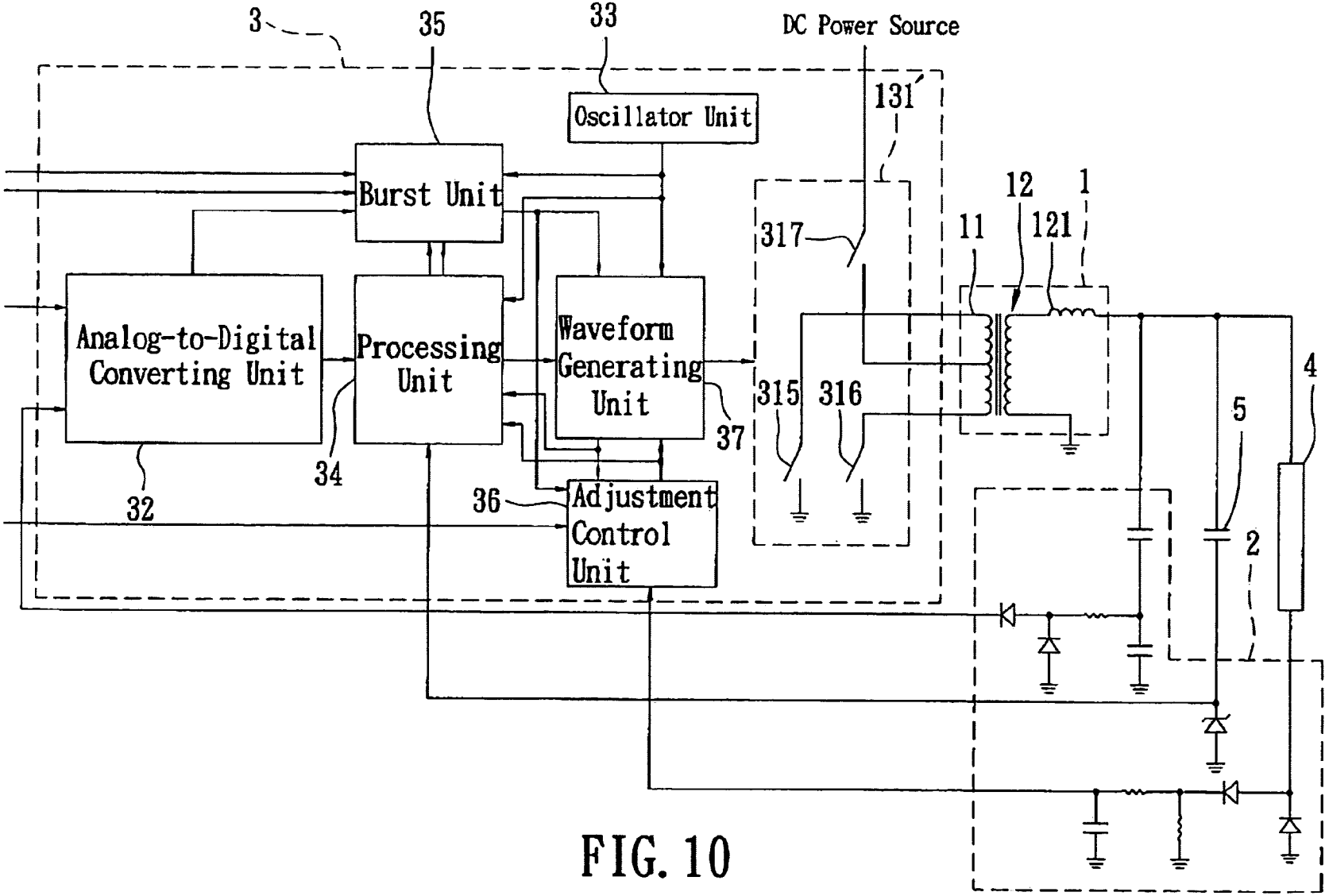
FIG. 10 is a circuit block diagram, illustrating the second preferred embodiment of a lamp driving circuit according to the present invention.

As shown in FIG. 10, the second preferred embodiment of the lamp driving circuit according to the present invention differs from the first preferred embodiment in the configuration of the switching unit 31'.

In the second preferred embodiment, the switching unit 31' is a 3-FET (field effect transistor) circuit, and includes three switches, namely a fifth switch 315, a sixth switch 316, and a seventh switch 317. The fifth switch 315 is coupled electrically between the first end of the primary winding 11 of the step-up transformer 1 and ground. The sixth switch 316 is coupled electrically between the second end of the primary winding 11 and ground. The seventh switch 317 is coupled electrically between a center tap of the primary winding 11 and the DC power source.

Figure 11:
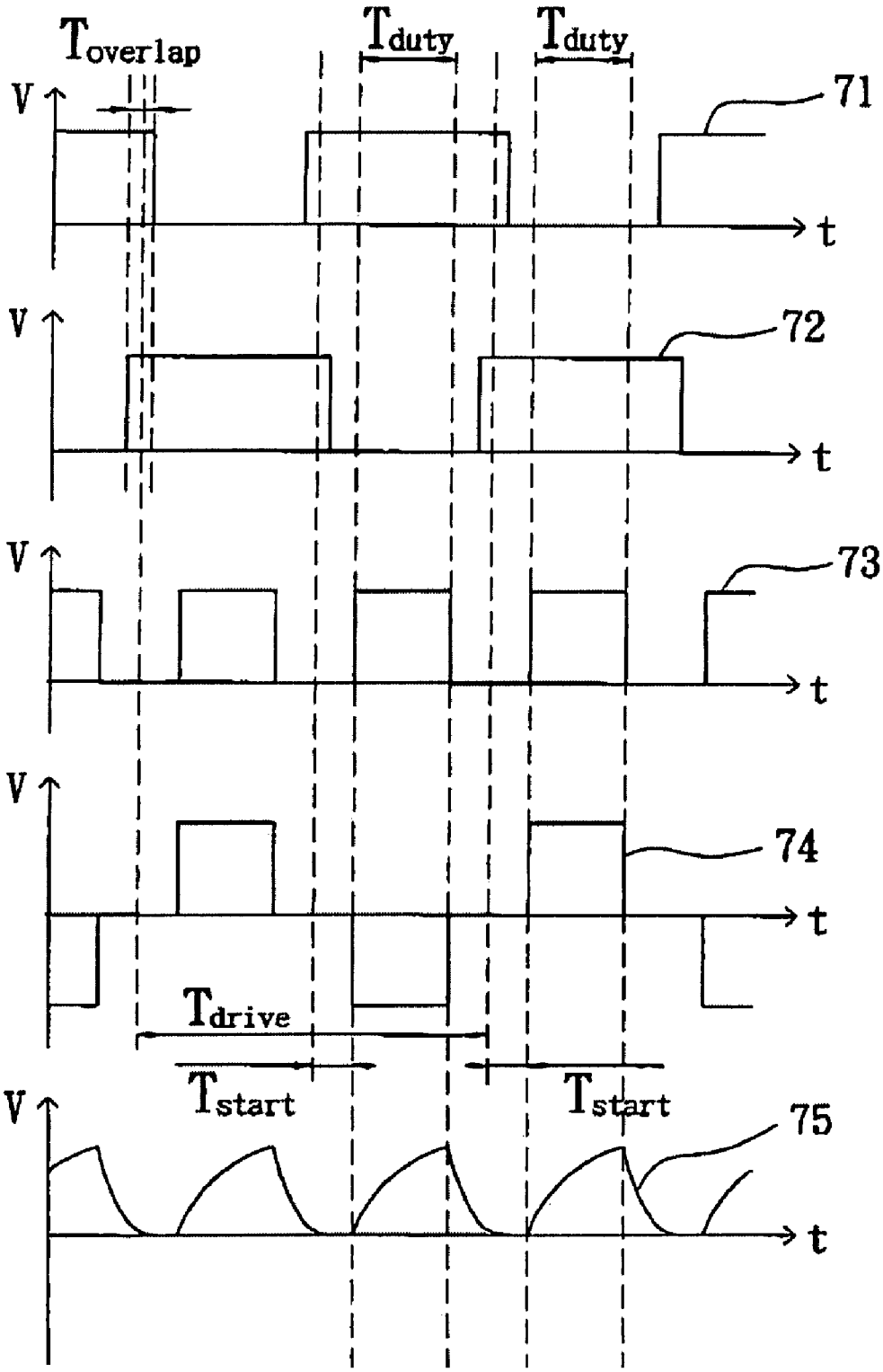
FIG. 11 is a timing diagram, illustrating waveforms of the set of control sub-signals, the drive signal, and the voltage across the capacitor in the second preferred embodiment.

Waveforms of control sub-signals for the fifth to seventh switches 315~317 of the switching unit 31', of the drive signal provided to the primary winding 11, and of the voltage across the capacitor 363, 366 (shown in FIG. 8 and FIG. 9) of the adjustment control unit 36, 36' are shown in FIG. 11, the horizontal axis denoting a time axis (t). Waveforms 71~73 respectively represent control sub-signals for the fifth to seventh switches 315~317, waveform 74 represents the drive signal, and waveform 75 represents the voltage across the capacitor 363, 366, where $T_{drive}$ denotes the period of the drive signal, $T_{start}$ denotes lag of positive or negative pulses of the drive signal from a start of a half period of the drive signal, $T_{duty}$ denotes the duration of a positive pulse or a negative pulse of the drive signal, and $T_{overlap}$ denotes a discharge duration to release energy stored by the primary winding 11. It should be noted herein that since $T_{overlap}$ is much smaller than $T_{drive}$, $T_{overlap}$ is enlarged in FIG. 11 for illustrative purposes.

High voltage levels of the waveforms 71~73 respectively represent closing (i.e., a conducting state) of the fifth to seventh switches 315~317, while low voltage levels of the waveforms 71~73 respectively represent opening (i.e., a non-conducting state) of the fifth to seventh switches 315~317.

In sum, the present invention uses an analog adjustment method for generating the termination signal, such that the smallest variation gradient in $T_{duty}$ is not limited by the period of the oscillating signal $T_{osc}$, thereby alleviating discontinuous change in lighting of the discharge lamp 4. In addition, the present invention utilizes the charging period of the capacitor 363, 366 and the first detecting signal, which corresponds to the current magnitude of the current flowing through the discharge lamp 4, and which is not converted into a corresponding digital value, to adjust $T_{duty}$ in real time, thereby avoiding circuit malfunction, and stabilizing the brightness of the light provided by the discharge lamp 4.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A lamp driving circuit configured for driving at least one discharge lamp, said lamp driving circuit comprising:

a step-up transformer including a primary winding, and a secondary winding coupled electrically to the at least one discharge lamp and adapted to cooperate with the at least one discharge lamp to form a tank circuit that generates a tank current;

a detector configured for detecting current magnitude of current flowing through the at least one discharge lamp, and outputting a first detecting signal that corresponds to the current magnitude detected thereby; and a controller coupled electrically to said primary winding of said step-up transformer, and to said detector for receiving the first detecting signal therefrom, said controller generating a drive signal for driving said step-up transformer;

wherein said controller includes a capacitor, and further receives a current-setting signal, said controller configuring a waveform of the drive signal by controlling charging of said capacitor based on a first calculation value that corresponds to a frequency of the drive signal, a start-setting value, and a difference between the first detecting signal and the current-setting signal.

2. The lamp driving circuit as claimed in claim 1, wherein start of the charging of said capacitor is controlled according to the start-setting value, and a charging period of said capacitor is controlled according to the difference between the first detecting signal and the current-setting signal, a duty ratio of the drive signal corresponding to the charging period of said capacitor.

3. The lamp driving circuit as claimed in claim 1, wherein said detector further detect phase of the tank current, and further outputs a second detecting signal that corresponds to the phase of the tank current, said controller further receiving the second detecting signal from said detector, the first calculation value being adjusted by said controller according to the second detecting signal.

4. The lamp driving circuit as claimed in claim 3, wherein said controller adjusts the first calculation value such that a phase difference between the drive signal and the tank current is approximately zero.

5. The lamp driving circuit as claimed in claim 3, wherein said controller further determines a phase difference between the drive signal and the tank current with reference to a phase-setting value.

6. The lamp driving circuit as claimed in claim 1, wherein said controller outputs an abnormal signal when a charging period of said capacitor exceeds a pre-selected range.

7. The lamp driving circuit as claimed in claim 1, wherein:

said controller includes a switching unit, an oscillator unit, a processing unit, an adjustment control unit, and a waveform generating unit;

said switching unit is coupled electrically to said primary winding of said step-up transformer, and to said waveform generating unit for receiving a control signal therefrom, said switching unit further receiving a direct-current power signal, and generating the drive signal for driving said step-up transformer from the direct-current power signal based on the control signal, the drive signal being a periodic alternating-current signal;

said oscillator unit is coupled electrically to said waveform generating unit and is for generating and outputting an oscillating signal to said waveform generating unit, frequency of the oscillating signal being greater than frequency of the drive signal;

said processing unit records the first calculation value and the start-setting value, and is coupled electrically to said waveform generating unit for providing the first calculation value and the start-setting value thereto;

said adjustment control unit is coupled electrically to said detector for receiving the first detecting signal therefrom, is further coupled electrically to said waveform generating unit for receiving a start signal therefrom and for outputting a termination signal thereto, and includes said capacitor, said adjustment control unit further receiving the current-setting signal, controlling start of the charging of said capacitor based on the start signal, and controlling a charging period of said capacitor based on the difference between the first detecting signal and the current-setting signal, said adjustment control unit outputting the termination signal upon termination of the charging of said capacitor; and said waveform generating unit receives the oscillating signal from said oscillator unit, receives the first calculation value and the start-setting value from said processing unit, receives the termination signal from said adjustment control unit, outputs the start signal to said adjustment control unit, and outputs the control signal to said switching unit, said waveform generating unit generating the start signal according to the first calculation value, the start-setting value and the oscillating signal, and further generating the control signal with reference to the termination signal.

8. The lamp driving circuit as claimed in claim 7, wherein:

said detector further detects phase of the tank current, and further outputs a second detecting signal that corresponds to the phase of the tank current, said processing unit being further coupled electrically to said detector for receiving the second detecting signal; and the first calculation value has a preset value, said processing unit adjusting the first calculation value from the preset value according to the second detecting signal.

9. The lamp driving circuit as claimed in claim 7, wherein said processing unit is further coupled electrically to said oscillator unit for receiving the oscillating signal therefrom, and to said adjustment control unit for receiving the termination signal therefrom, and further receives the start signal from said waveform generating unit, said processing unit generating a second calculation value based on the start signal, the termination signal and the oscillating signal, and outputting an abnormal signal when the charging period of said capacitor exceeds a pre-selected range.

10. The lamp driving circuit as claimed in claim 7, wherein:

each of the first detecting signal and the current-setting signal is a voltage signal, said adjustment control unit further including a differential amplifier, a current adjuster, and a comparator;

said differential amplifier is coupled electrically to said detector for receiving the first detecting signal therefrom, and further receives the current-setting signal, said differential amplifier determining and amplifying the difference between the first detecting signal and the current-setting signal so as to generate a difference signal;

said current adjuster is coupled electrically to said differential amplifier for receiving the difference signal therefrom, is further coupled electrically to said waveform generating unit for receiving the start signal therefrom, is further coupled electrically to said capacitor, and generates a charging current for charging said capacitor, said current adjuster decreasing the charging current when the difference signal indicates that the first detecting signal is smaller than the current-setting signal, said current adjuster increasing the charging current when the difference signal indicates that the first detecting signal is greater than the current-setting signal, said current adjuster terminating the charging of said capacitor and starting to discharge said capacitor upon receipt of the termination signal, until a voltage across said capacitor becomes zero; and said comparator is coupled electrically to said capacitor for comparing the voltage across said capacitor with a reference voltage, and is further coupled electrically to said current adjuster and said waveform generating unit for generating and outputting the termination signal thereto when the voltage across said capacitor is greater than the reference voltage.

11. The lamp driving circuit as claimed in claim 7, wherein:

each of the first detecting signal and the current-setting signal is a voltage signal, said adjustment control unit further including a current generator, a differential integrator, and a comparator;

said current generator is coupled electrically to said waveform generating unit for receiving the start signal therefrom, is further coupled electrically to said capacitor, and generates a charging current for charging said capacitor, said current generator terminating the charging of said capacitor and starting to discharge said capacitor upon receipt of the termination signal, until a voltage across said capacitor becomes zero;

said differential integrator is coupled electrically to said detector for receiving the first detecting signal therefrom, and further receives the current-setting signal, said differential integrator integrating and amplifying the difference between the first detecting signal and the current-setting signal so as to generate a reference voltage, said differential integrator increasing the reference voltage when the first detecting signal is smaller than the current-setting signal, said differential integrator decreasing the reference voltage when the first detecting signal is greater than the current-setting signal; and said comparator is coupled electrically to said differential integrator for receiving the reference voltage therefrom, is further coupled electrically to said capacitor for comparing the voltage across said capacitor with the reference voltage, and is further coupled electrically to said current generator and said waveform generating unit for generating and outputting the termination signal thereto when the voltage across said capacitor is greater than the reference voltage.

12. A control method to be implemented using a lamp driving circuit that is configured for driving at least one discharge lamp, and that includes a step-up transformer, the step-up transformer including a primary winding and a secondary winding coupled electrically to the at least one discharge lamp and cooperate with the at least one discharge lamp to form a tank circuit that generates a tank current, the control method comprising the steps of:

detecting current magnitude of current flowing through the at least one discharge lamp, and outputting a first detecting signal that corresponds to the current magnitude thus detected; and configuring a waveform of a drive signal used to drive the step-up transformer by controlling charging of a capacitor based on a first calculation value that corresponds to a frequency of the drive signal, a start-setting value, and a difference between the first detecting signal and a current-setting signal.

13. The control method as claimed in claim 12, wherein start of the charging of the capacitor is controlled according to the start-setting value, and a charging period of the capacitor is controlled according to the difference between the first detecting signal and the current-setting signal, a duty ratio of the drive signal corresponding to the charging period of the capacitor.

14. The control method as claimed in claim 12, further comprising the steps of:

detecting phase of the tank current, and outputting a second detecting signal that corresponds to the phase of the tank current; and adjusting the first calculation value according to the second detecting signal.

15. The control method as claimed in claim 14, wherein the first calculation value is adjusted such that a phase difference between the drive signal and the tank current is approximately zero.

16. The control method as claimed in claim 14, further comprising the step of determining a phase difference between the drive signal and the tank current with reference to a phase-setting value.

17. The control method as claimed in claim 12, further comprising the step of outputting an abnormal signal when a charging period of the capacitor exceeds a pre-selected range.

* * * * *